US006502783B1

(12) United States Patent
Smith et al.

(10) Patent No.: US 6,502,783 B1
(45) Date of Patent: Jan. 7, 2003

(54) CARRIER TAPE RECYCLING APPARATUS AND METHOD OF RECYCLING CARRIER TAPE

(75) Inventors: Derek T. Smith, Eagle, ID (US); Tony T. Ibarra, Nampa, ID (US); Merle Bicknell, Nampa, ID (US); Todd D. Higgins, Nampa, ID (US)

(73) Assignee: Micron Technology, Inc., Boise, ID (US)

( * ) Notice: Subject to any disclaimer, the term of this patent is extended or adjusted under 35 U.S.C. 154(b) by 45 days.

(21) Appl. No.: 09/639,279

(22) Filed: Aug. 15, 2000

(51) Int. Cl.[7] ..... B65H 18/08

(52) U.S. Cl. ..... 242/530.3; 242/393; 242/534; 242/540; 242/541; 242/594.2; 242/594.3

(58) Field of Search ..... 242/545.1, 540, 242/541, 393, 530.3, 564.5, 595.1, 598.4, 594.1, 594.2, 534

(56) References Cited

U.S. PATENT DOCUMENTS

| | | | | | |
|---|---|---|---|---|---|
| 2,267,161 | A | * | 12/1941 | Miller | 242/420.1 |
| 2,679,987 | A | * | 6/1954 | Saliba | 242/393 |
| 2,904,273 | A | * | 9/1959 | Turner | 242/470 |
| 3,105,647 | A | * | 10/1963 | Maejima | 242/540 |
| 3,375,991 | A | * | 4/1968 | Conforti | 242/470 |
| 3,685,760 | A | * | 8/1972 | Fedor | 242/560.2 |
| 3,692,252 | A | * | 9/1972 | Perconti | 242/541.5 |
| 4,029,536 | A | | 6/1977 | Kovacs et al. | |
| 4,512,843 | A | | 4/1985 | Miyazaki | |
| 4,657,137 | A | | 4/1987 | Johnson | |
| 4,660,282 | A | | 4/1987 | Pfaff | |
| 4,716,124 | A | | 12/1987 | Yerman et al. | |
| 4,770,360 | A | * | 9/1988 | Liebelt | 242/530 |
| 4,787,568 | A | * | 11/1988 | Mulfarth | 242/533 |
| 4,804,152 | A | * | 2/1989 | Masuda | 242/540 |
| 4,810,154 | A | | 3/1989 | Klemmer et al. | |
| 4,816,195 | A | * | 3/1989 | Hettinger | 264/29.2 |
| 4,980,219 | A | | 12/1990 | Hiraide et al. | |
| 5,136,827 | A | | 8/1992 | Sawaya | |
| 5,148,969 | A | | 9/1992 | Boucher et al. | |
| 5,213,653 | A | | 5/1993 | Akahori et al. | |
| 5,268,059 | A | | 12/1993 | Olson | |
| 5,299,902 | A | | 4/1994 | Fujiwara et al. | |
| 5,454,900 | A | | 10/1995 | Han et al. | |
| 5,496,432 | A | | 3/1996 | Sumi et al. | |
| 5,575,136 | A | | 11/1996 | Caldwell et al. | |
| 5,715,592 | A | | 2/1998 | Mori et al. | |
| 5,783,007 | A | * | 7/1998 | Boyd | 156/64 |
| 5,966,903 | A | | 10/1999 | Dudderar et al. | |
| 5,967,365 | A | | 10/1999 | Bogursky et al. | |
| 5,974,903 | A | | 11/1999 | Shirley et al. | |
| 6,213,423 | B1 | * | 4/2001 | St. Germain | 242/559.2 |
| 6,247,664 | B1 | * | 6/2001 | Petersen | 242/485.6 |

* cited by examiner

*Primary Examiner*—John M. Jillions
(74) *Attorney, Agent, or Firm*—TraskBritt

(57) ABSTRACT

A carrier tape recycling apparatus for receiving bare carrier tape from a manufacturing system and for winding the carrier tape onto a plurality of tape reels for reuse. The carrier tape recycling apparatus includes a reel drive mechanism configured to support and rotationally drive a plurality of tape reels such that bare carrier tape dispensed from the manufacturing system may be wound onto the tape reels. The reel drive mechanism provides a slip drive allowing each tape reel disposed in the recycling apparatus to rotate and receive carrier tape independent of other tape reels disposed in the recycling apparatus, so as to compensate for variation in the rate at which carrier tape is supplied to each tape reel disposed in the carrier tape recycling apparatus. The present invention also includes a method of using the recycling apparatus to recycle bare carrier tape dispensed from a manufacturing system.

40 Claims, 8 Drawing Sheets

CARRIER TAPE RECYCLING APPARATUS AND METHOD OF RECYCLING CARRIER TAPE

BACKGROUND OF THE INVENTION

1. Field of the Invention

The present invention relates generally to the manufacture and assembly of electronic, mechanical, or electromechanical components comprised of various small devices such as bare semiconductor die, packaged semiconductor die, lead frames, other electronic devices, small mechanical parts, or any combination thereof More particularly, the present invention relates to the supply and handling of small devices on a carrier tape and, specifically, to an apparatus and method for recycling the carrier tape after removal of the devices carried thereon.

2. State of the Art

Electronic, mechanical, and electromechanical components are commonly manufactured using fully, or at least partially, automated manufacturing systems. Complex assemblies, such as, for example, multichip memory modules, motherboards, and other control modules, are often comprised of numerous—and, in some instances, dozens of—bare and/or packaged semiconductor die as well as other electronic devices such as resistors, capacitors, heat sinks, and LEDs. Further, the numerous parts or subassemblies that are incorporated into a complex electrical or mechanical component may be of greatly varying size and shape. Thus, for many applications, a critical facet of automated manufacturing is the supply and handling of discrete parts for assembly into a next-level component.

A common method for supplying and handling large numbers of discrete parts in automated manufacturing systems is to employ a carrier tape. Referring to FIGS. 1 and 2, a typical carrier tape 10 comprises a continuous tape 12 having one or more rows of pockets 14 disposed thereon. The pockets 14 are each configured to receive a particular part such as, for example, a bare semiconductor die, a packaged semiconductor die, a lead frame, an electronic device, or a small mechanical part. Each pocket 14 may include an aperture 15 for passage therethrough of a push-out pin for extracting a part resting within the pocket 14. One or more raised portions 16 may be disposed in each pocket 14 for supporting a part resting therein. Disposed proximate each edge 13 of the continuous tape 12 is one or more rows of indexing holes 18. The indexing holes 18 may be of any suitable shape, such as, for example, circular 18*a* or rectangular 18*b*.

The configuration of the carrier tape 10 shown in FIGS. 1 and 2 is only exemplary and numerous other carrier tape configurations are known in the art. For example, a carrier tape 10 may include multiple rows of pockets 14, multiple rows of indexing holes 18 adjacent each edge 13, or indexing holes 18 arranged along only one edge 13. The carrier tape 10 may also include a protective covering (not shown) adhered to the top surface of the continuous tape 12 to protect parts disposed in the pockets 14 prior to extraction. Carrier tape 10 is conventionally manufactured from a variety of plastic materials, such as, for example, a polycarbonate material, as well as from metallic materials.

A common medium for storing, transporting, and handling a plurality of parts borne on a length of carrier tape 10 is a tape reel. A typical tape reel 20 is shown in FIGS. 3 and 4. The tape reel 20 includes a hub 22 extending between and attached to opposing side plates 24. Each side plate 24 is disk-shaped and includes an outer circumferential edge 25 and an outer surface 26. The tape reel 20 has a thickness 21 corresponding to the distance between the outer surfaces 26 of the opposing side plates 24. Extending through the hub 22 and concentric with the axis of rotation 27 of the tape reel 20 is a shaft hole 28 configured for insertion of a shaft (not shown) therethrough to rotationally support the tape reel 20. To facilitate rotation of a tape reel 20, the shaft hole 28 may have a "key" shape, such as the three-prong shape shown in FIG. 3, enabling the tape reel 20 to be positively rotationally driven by a mating shaft. The tape reel 20 may further include a plurality of windows 29 disposed in the side plates 24 for viewing the quantity of carrier tape 10 wound on the hub 22. The configuration of the tape reel 20 shown in FIGS. 3 and 4 is only exemplary and other tape reel configurations are known in the art.

Automated manufacturing systems adapted for manipulating reels of carrier tape, and the parts disposed therein, are well-known in the art. Manufacturing systems adapted for removing parts from carrier tape 10 wound on a tape reel 20 generally include an extraction mechanism for removing the parts carried in the pockets 14 of the carrier tape 10 and a feed mechanism for feeding carrier tape 10 from a tape reel 20 to the extraction mechanism. A typical extraction mechanism includes an extraction head configured to remove a part from a pocket 14 of a carrier tape 10, as well as a push-out pin to assist in the extraction. An extraction head may comprise a vacuum quill, a mechanical gripping mechanism, or any other suitable extraction device known in the art.

Extraction of the parts borne on a carrier tape 10 requires that the pockets 14 arranged in a row along the length of the carrier tape 10 be sequentially positioned into a target location underneath or proximate the extraction head. Further, removal of a part from its respective pocket 14 on the carrier tape 10 generally requires that the pocket 14 be substantially aligned with the extraction head. The feed mechanism sequentially feeds, or indexes, the pockets 14 on a length of carrier tape 10 relative to the extraction head and aligns an individual pocket 14 therewith, using the indexing holes 18 of the carrier tape 10. A typical feed mechanism includes a plurality of indexing teeth—arranged, for example, around an outer circumferential edge of a feed wheel—configured to closely mate with the row or rows of indexing holes 18 of the carrier tape 10. With one or more indexing teeth engaging each row of indexing holes 18 on a length of carrier tape 10, feeding and alignment of the pockets 14 on the carrier tape 10 relative to an extraction head is effected by movement of the indexing teeth. Feeding of the carrier tape 10 to the extraction mechanism, and precise alignment of a pocket 14 on the carrier tape 10 relative thereto, can be achieved so long as a close mating relationship exists between the indexing teeth of the feed mechanism and the carrier tape indexing holes 18. If the close mating fit between the indexing teeth and carrier tape indexing holes 18 is compromised—for example, by damage to the carrier tape indexing holes 18—feeding and precise alignment of the carrier tape 10 relative to the extraction mechanism may no longer be possible.

After removal of the parts borne on a carrier tape, a typical automated manufacturing system feeds the emptied, or bare, carrier tape into a storage bin or receptacle. For some manufacturing systems, the bare carrier tape is simply allowed to collect on the floor of the manufacturing facility, presenting a potential safety hazard. The bare carrier tape is then disposed of as waste, resulting in a large quantity of plastic waste being discarded in landfills and other disposal sites, thereby creating an adverse environmental impact. As the manufacture and assembly of electronic, mechanical, and electromechanical components becomes increasingly automated—especially in the semiconductor and electronics industries—the amount of waste carrier tape disposed of will increase and, accordingly, the adverse environmental impact will grow.

Disposing of bare carrier tape as waste also increases manufacturing costs. A length of carrier tape is currently utilized only once during its lifetime; however, after removal of the parts borne on a length of carrier tape by an automated manufacturing system, the bare carrier tape may be essentially undamaged. It is believed that carrier tape may be reused so long as the integrity of the indexing holes of the carrier tape is maintained.

Accordingly, a need exists for an apparatus and method for retrieving carrier tape from a manufacturing system without damage to the carrier tape, enabling the carrier tape to be reused, and without adversely affecting operation of the manufacturing system.

SUMMARY OF THE INVENTION

Embodiments of the present invention comprise a carrier tape recycling apparatus configured for receiving bare carrier tape from multiple feed lines of a manufacturing system and for winding the carrier tape onto a plurality of tape reels for reuse. The carrier tape recycling apparatus comprises a housing, or frame, supporting a reel drive mechanism. The reel drive mechanism supports and rotationally drives one or more tape reels such that bare carrier tape dispensed from a manufacturing system may be wound onto the tape reels. The reel drive mechanism provides a slip drive, allowing each tape reel disposed in the recycling apparatus to rotate—or, in some instances, cease rotating—and to receive carrier tape independent of the other tape reels disposed in the recycling apparatus. The slip drive, therefore, compensates for variation in carrier tape feed rate among multiple feed lines dispensing bare carrier tape from a manufacturing system, and the slip drive also prevents excessive tension from being imparted to the bare carrier tape as the carrier tape is wound onto a tape reel.

In an exemplary embodiment of the carrier tape recycling apparatus, the reel drive mechanism comprises one or more drive shafts and one or more guide shafts configured to cooperatively support and rotationally drive a plurality of tape reels. A tape reel disposed in the recycling apparatus is rotationally driven by frictional forces imparted to the outer circumferential edges of the tape reel by the outer circumferential surface, or drive surface, of the drive shaft or shafts in contact therewith. A plurality of guides disposed on the guide shaft or shafts provide lateral support for a tape reel disposed in the recycling apparatus while permitting the tape reel to rotate. The respective positions of the guide shaft or shafts and associated guides may be altered to configure the recycling apparatus for use with varying sizes and numbers of tape reels. The reel drive mechanism further includes a drive motor to rotationally drive the drive shafts and tape reels in contact therewith. A drive coupling mechanism, such as a belt and pulley mechanism, operably couples the drive motor to the drive shaft or shafts.

The present invention may include a method of using the carrier tape recycling apparatus to recycle bare carrier tape dispensed from a manufacturing system. In an exemplary embodiment, a carrier tape recycling apparatus according to the present invention is disposed proximate a manufacturing system dispensing bare carrier tape from one or more feed lines. The recycling apparatus is configured to support the desired number and size of tape reels. An end of the bare carrier tape being dispensed from each feed line is then secured to a hub of a tape reel. As bare carrier tape is dispensed from a feed line of the manufacturing system, the bare carrier tape is wound onto a tape reel as that tape reel is rotationally driven by the reel drive mechanism. If the manufacturing system halts the flow of carrier tape from a feed line, the slip drive provided by the reel drive mechanism allows a tape reel disposed in the recycling apparatus and receiving bare carrier tape from the halted feed line to cease rotation, or stall, while simultaneously allowing other tape reels disposed in the recycling apparatus to continue rotating and receiving bare carrier tape from the manufacturing system. When a tape reel is full of bare carrier tape, the full tape reel is removed from the recycling apparatus by simply lifting the full tape reel upwards out of the reel drive mechanism. An empty tape reel may then be inserted in place of the full tape reel.

BRIEF DESCRIPTION OF THE SEVERAL VIEWS OF THE DRAWINGS

While the specification concludes with claims particularly pointing out and distinctly claiming that which is regarded as the present invention, the features and advantages of this invention can be more readily ascertained from the following detailed description of the invention when read in conjunction with the accompanying drawings, in which:

DETAILED DESCRIPTION OF THE INVENTION

Figure 1:
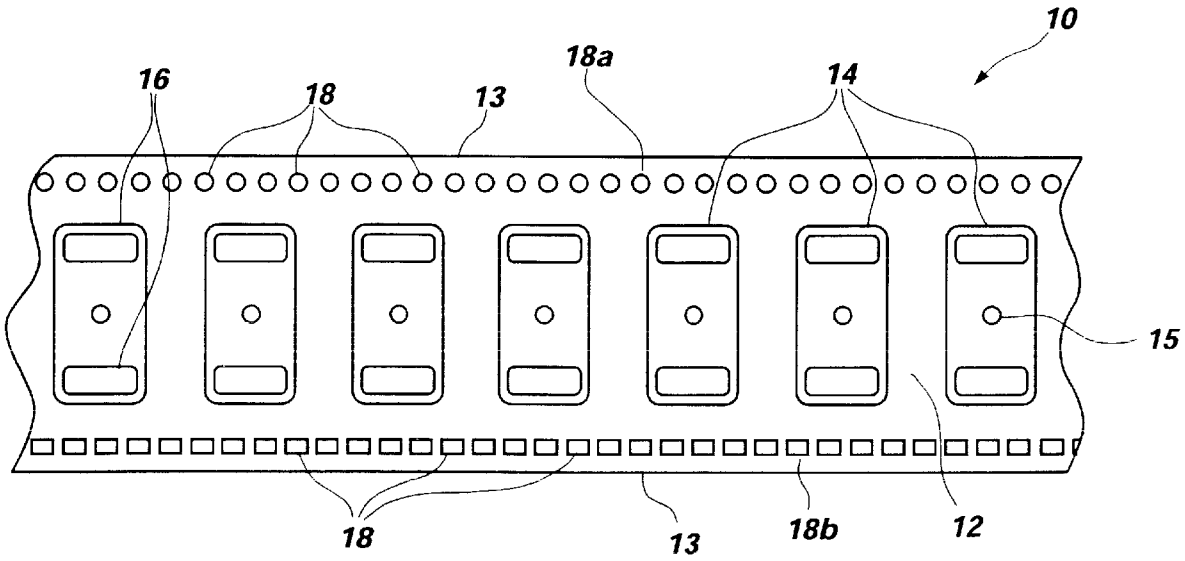
Fig. 1 (PRIOR ART)
FIG. 1 is a plan view of a lengthwise section of conventional carrier tape.
Figure 2:
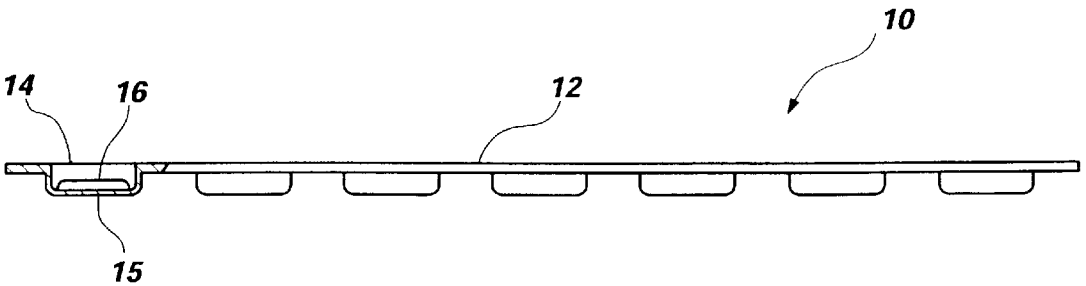
Fig. 2 (PRIOR ART)
FIG. 2 is a side elevation view of the lengthwise section of conventional carrier tape shown in FIG. 1.
Figure 4:
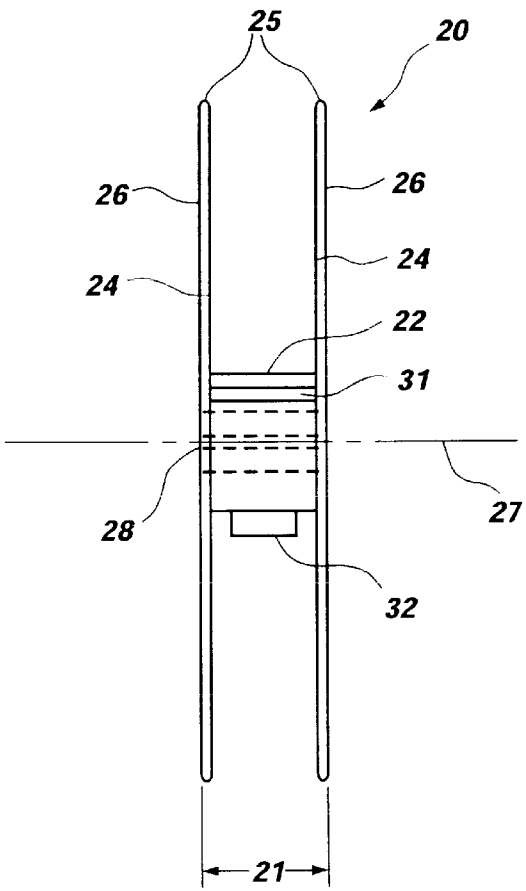
Fig. 4 (PRIOR ART)
FIG. 4 is a side elevation view of the conventional tape reel for receiving a length of conventional carrier tape shown in FIG. 3.
Figure 3:
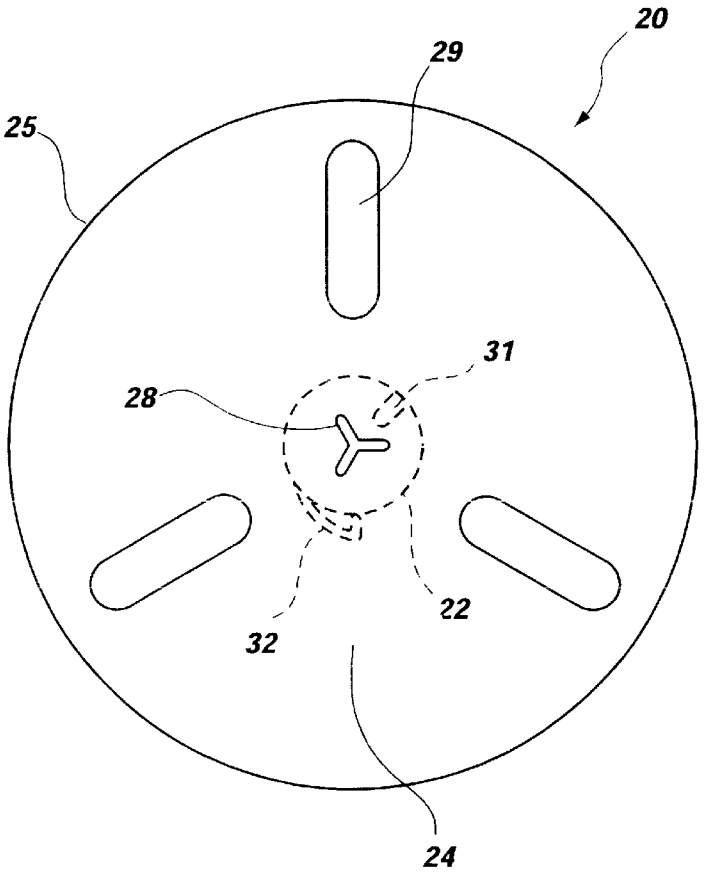
Fig. 3 (PRIOR ART)
FIG. 3 is a front elevation view of a conventional tape reel for receiving a length of conventional carrier tape.

An exemplary embodiment of a carrier tape recycling apparatus 50 according to the present invention is shown in FIGS. 5 through 10. The recycling apparatus 50 is adapted to receive bare carrier tape 10 from multiple feed lines 90 of a manufacturing system (not shown in figures) and to wind the carrier tape 10 onto a plurality of tape reels 20. The carrier tape 10 may be any suitable carrier tape configuration known in the art, such as, for example, the exemplary carrier tape 10 shown in FIGS. 1 and 2. Similarly, the tape reels 20 may be of any suitable configuration known in the art, such as, by way of example, the exemplary tape reel 20 shown in FIGS. 3 and 4. The recycling apparatus 50 may be configured for use with, and to receive bare carrier tape 10 from, any manufacturing system known in the art.

Figure 5:
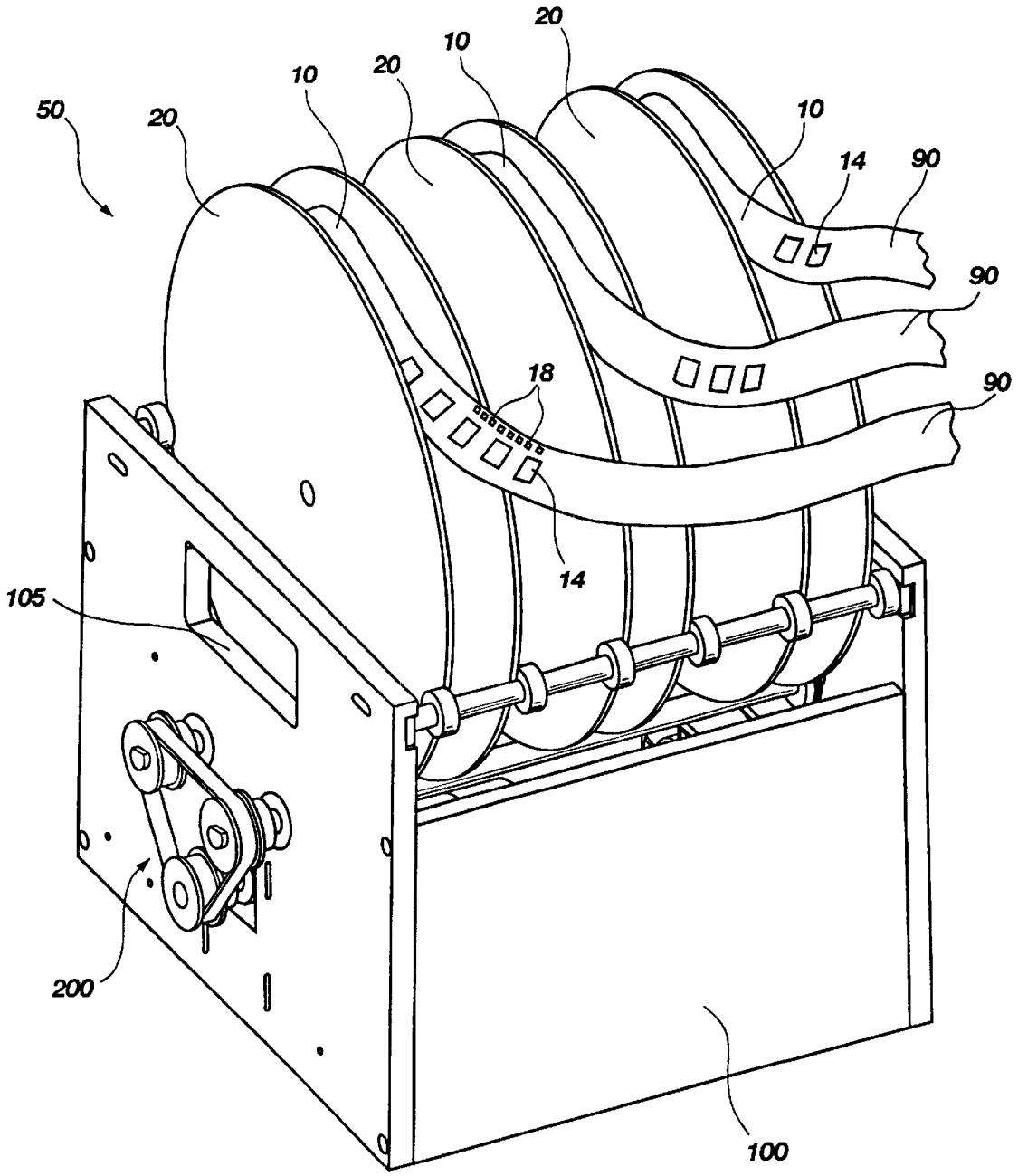
FIG. 5 is a perspective view of a carrier tape recycling apparatus according to the present invention.

Referring to FIG. 5, the recycling apparatus 50 includes a housing 100 configured to support a reel drive mechanism 200. The housing 100 may partially enclose the reel drive mechanism 200 to function as a safety shield for any moving parts of the reel drive mechanism 200. The housing 100 may include a cover 180 (see FIG. 10) to provide additional shielding for the drive mechanism 200. The housing 100 may further include a handle 105 to facilitate transportation of the recycling apparatus 50. In an alternative embodiment, the housing 100 may simply be a frame structure configured to support—but not partially enclose—the drive mechanism 200. Any suitable materials may be used to construct the housing 100 including, by way of example, ferrous metals such as stainless steel, nonferrous metals such as aluminum, and plastic materials.

The reel drive mechanism 200 is adapted to support and rotationally drive one or more tape reels 20 such that bare carrier tape 10 dispensed from multiple feed lines 90 of a manufacturing system may be wound onto the tape reels 20 for reuse. Although FIGS. 5 through 10 show three tape reels 20 supported by the reel drive mechanism 200, the reel drive mechanism 200 may be adapted to receive any suitable number of tape reels 20 as necessary.

Referring to FIGS. 6 through 9, the reel drive mechanism 200 includes one or more drive shafts 210 and one or more guide shafts 220. The drive shafts 210 and guide shafts 220 are configured to cooperatively support and rotationally drive a plurality of tape reels 20. Each drive shaft 210 is rotatably supported at opposing ends by bearings 212, the bearings 212 being retained by the housing 100 at bearing supports 112. Each tape reel 20 disposed in the recycling apparatus 50 rests, under the force of gravity, on the drive shafts 210, such that the outer circumferential edges 25 of each tape reel 20 contact the outer circumferential surface 211 of a drive shaft 210. The drive shaft or shafts 210 may be constructed of any suitable material such as, for example, steel or alloys thereof. Also, the outer circumferential surface, or drive surface, 211 of a drive shaft 210 may have a polished finish or any other suitable surface treatment or coating as known in the art.

The guide shafts 220 provide lateral support for a tape reel 20 disposed in the recycling apparatus 50 while permitting the tape reel 20 to rotate. Lateral support is provided by a plurality of guides 222 secured to each guide shaft 220. The guides 222 are axially spaced along each guide shaft 220 at locations corresponding to a thickness 21 of the tape reels 20, such that an outer surface 223 of at least one guide 222 on one guide shaft 220 is positioned adjacent the outer surface 26 of each disk-shaped side plate 24 on a tape reel 20. In one embodiment of the invention in which there are two guide shafts 220, as shown in FIGS. 5 through 10, a total of four guides 222 laterally support each tape reel 20. Although the guides 222 are positioned on a guide shaft 220 such that an outer surface 223 of each guide 222 is at a location corresponding to an outer surface 26 of a tape reel 20, the outer surface 223 of a guide 222 does not necessarily contact the outer surface 26 of the tape reel 20. The guides 222 may be secured in place on a guide shaft 220 using any suitable fastener (not shown in figures) such as, for example, a set screw.

The opposing ends of a guide shaft 220 are secured to the housing 100 by adjustable couplings 224. The adjustable couplings 224 allow the position of a guide shaft 220 to be adjusted relative to the drive shaft or shafts 210 in order to accommodate tape reels 20 of various sizes. For example, as the outside diameter of the tape reels 20 increases in size, the guide shafts 220 must be positioned increasingly outward of the drive shafts 210. In one embodiment of the invention, as shown in FIGS. 5 though 10, an adjustable coupling 224 comprises a slide block 226 secured to an end of a guide shaft 220 configured to slidably mate with a corresponding slot 126 disposed in the housing 100. Any suitable fastener 227 (see FIG. 8), such as a set screw, may be used to secure the slide block 226 at a desired position within the slot 126. To adapt the recycling apparatus 50 for use with a specific size tape reel 20, the slide blocks 226 on the opposing ends of each guide shaft 220 are positioned and secured within their respective slot 126 on housing 100 such that the outer circumferential edges 25 of a tape reel 20 are proximate to, though not necessarily in contact with, the outer circumferential surface 221 of the guide shaft 220.

The guide shaft or shafts 220 may be fabricated from any suitable material such as, by way of example, steel or alloys thereof. The outer circumferential surface 221 of a guide shaft 220 may include a polished finish, or any other suitable surface treatment or coating as known in the art, to reduce the frictional forces, or drag, imparted on a tape reel 20 by the guide shafts 220. The guides 222 may also be fabricated from any suitable material such as, for example, a plastic material or a metallic material such as aluminum. Also, the guides 222 may include outer surfaces 223 having a polished finish, or any other suitable surface treatment or coating, to reduce frictional drag imparted on the tape reel 20 by the guides 222.

It will be understood by those of ordinary skill in the art that any suitable number and combination of drive shafts 210 and guide shafts 220 may be incorporated into a recycling apparatus 50 according to the present invention. For example, in one embodiment of the invention shown in FIGS. 5 through 10, the recycling apparatus 50 includes two drive shafts 210 and two guide shafts 220. Alternatively, the recycling apparatus 50 may include, by way of example only, one drive shaft 210 and one guide shaft 220, one drive shaft 210 and two guide shafts 220, or two drive shafts 210 and one guide shaft 220.

The reel drive mechanism 200 further includes a drive motor 230 operably coupled to the drive shaft or shafts 210 via a drive coupling mechanism 240. The drive motor 230 may be any suitable rotary motor as known in the art, such as, for example, an electromagnetic motor, capable of rotating the tape reels 20 at a desired rotational speed. An exemplary rotational speed for the tape reels 20 is in the range of 1 to 15 revolutions per minute (rpm). As the rate at which a manufacturing system dispenses bare carrier tape 10 changes and, further, as the outer radius of a roll of carrier tape 10 wound around a hub 22 of a tape reel 20 increases, it may be necessary to alter the rotational speed of the tape reels 20 receiving carrier tape 10 from the manufacturing system and, hence, the rotational speed of the output shaft 232 of the drive motor 230.

Figure 7:
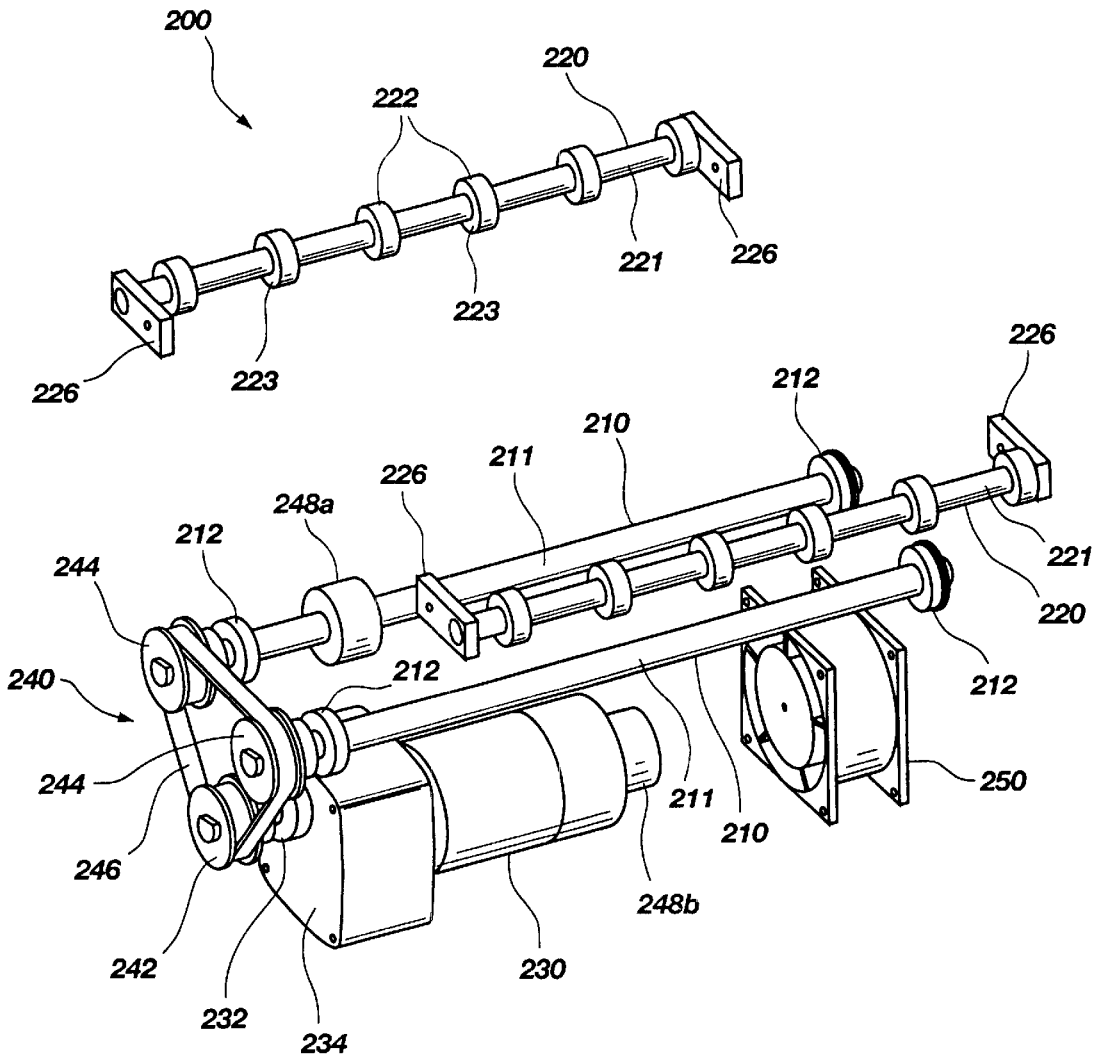
FIG. 7 is a perspective view of the carrier tape recycling apparatus of the present invention with the housing removed for clarity.
Figure 8:
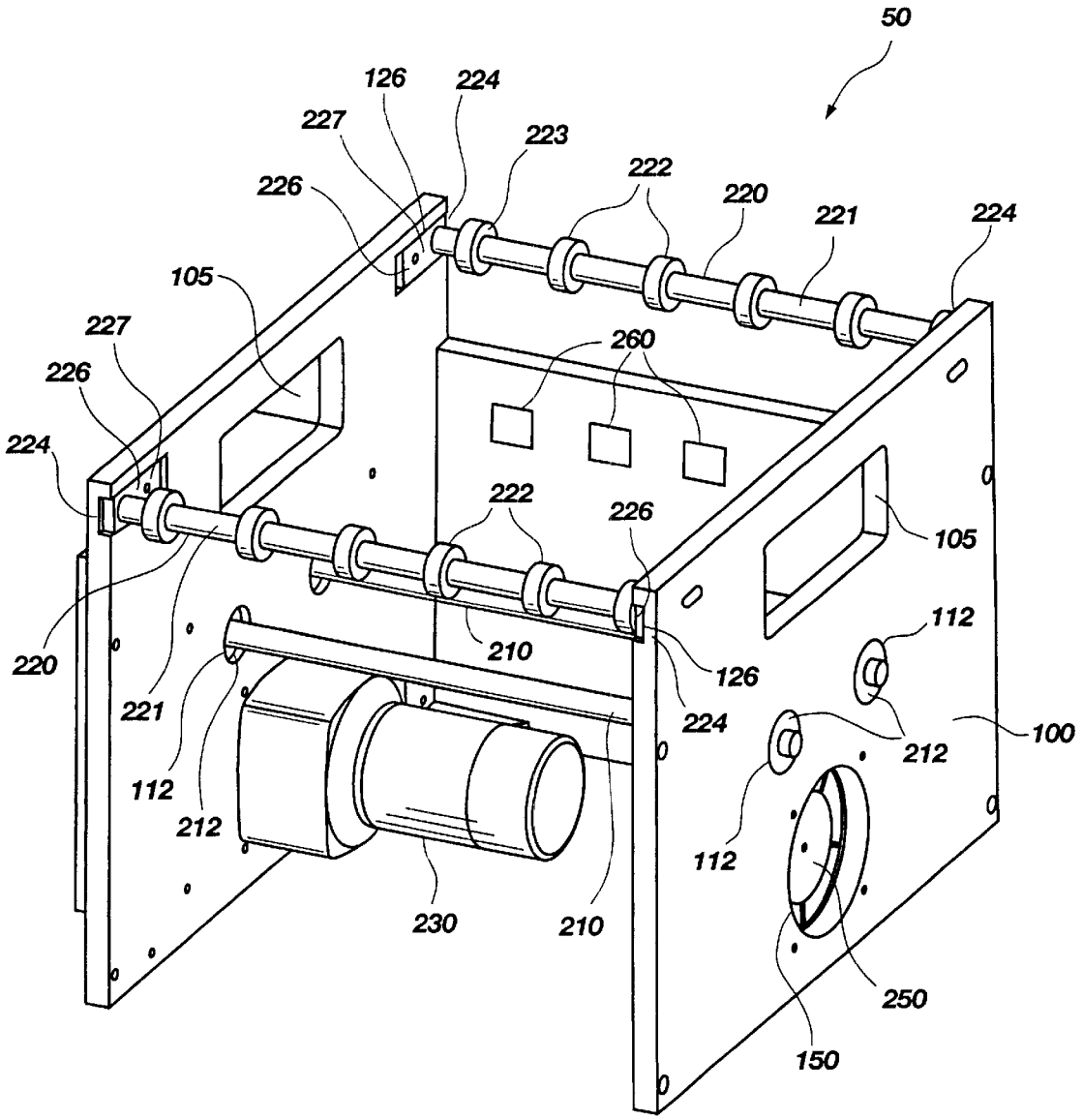
FIG. 8 is a perspective view of the carrier tape recycling apparatus of the present invention with a portion of the housing removed for clarity.
Figure 9:
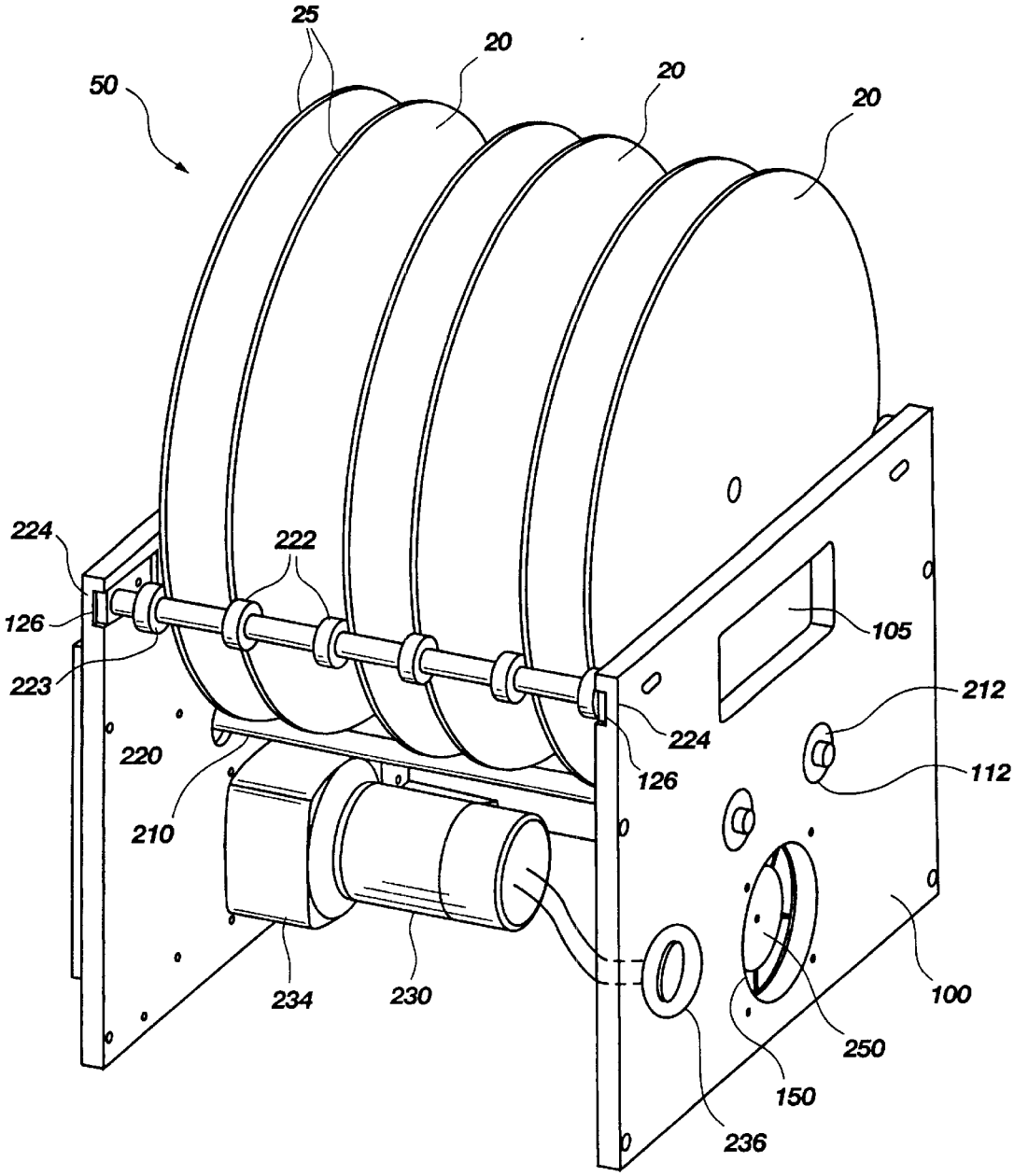
FIG. 9 is a perspective view of the carrier tape recycling apparatus of the present invention with a portion of the housing removed for clarity.
Figure 10:
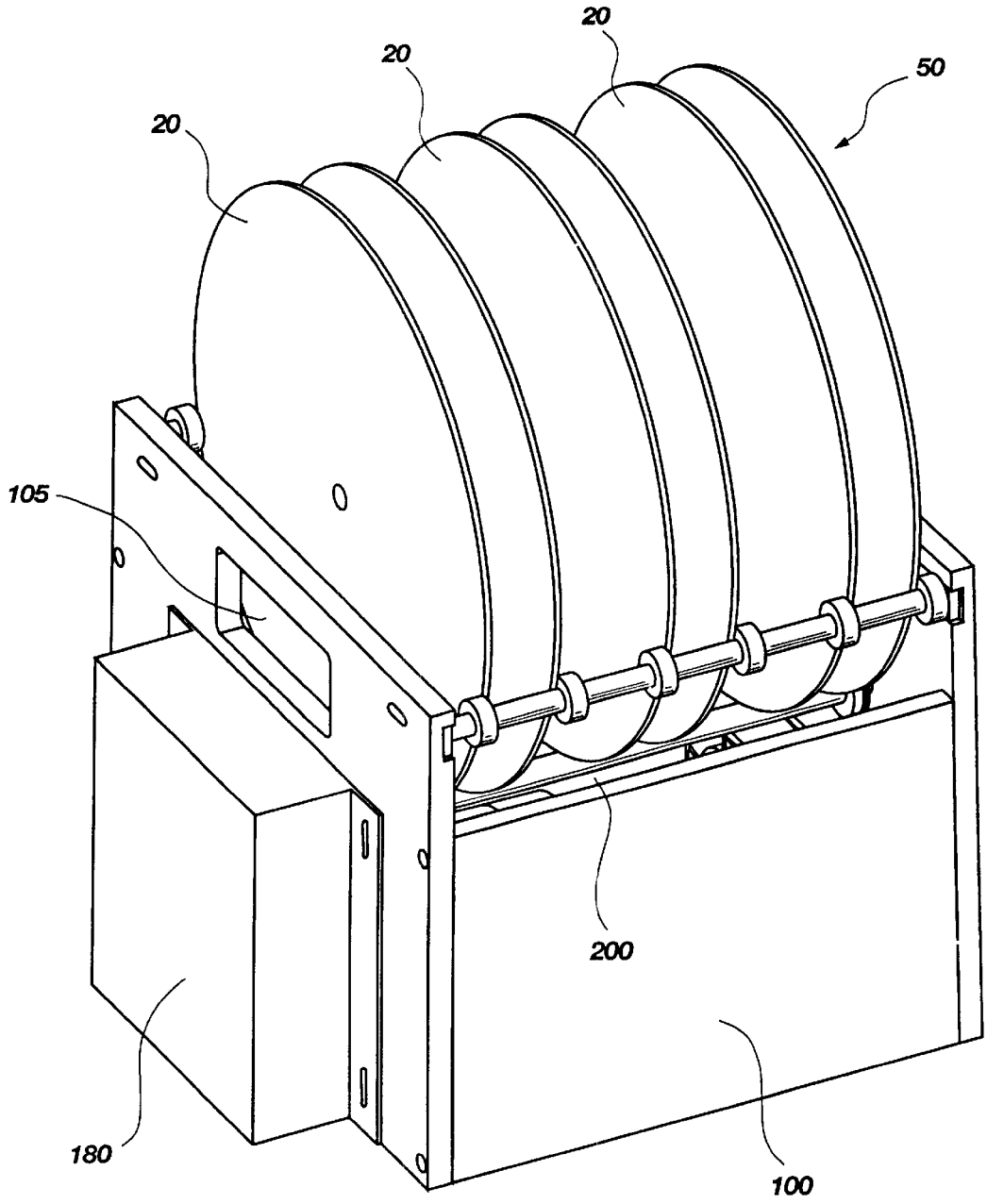
FIG. 10 is a perspective view of the carrier tape recycling apparatus of the present invention.

The rotational speed of the output shaft 232 of the drive motor 230 may be manually controlled using a voltage or current control device 236 (see FIG. 9) such as, for example, a potentiometer. Alternatively, closed-loop control circuitry may be employed to maintain the desired rotational speed of the tape reels 20. As shown in FIG. 7, closed-loop control may be facilitated using a rotary sensor 248*a* to sense a rotational speed of one of the drive shafts 210 or using a rotary sensor 248*b* to sense a rotational speed of the output shaft 232 of the drive motor 230. The rotary sensor 248*a*, 248*b* may be any suitable rotary sensor known in the art, such as, for example, an optical encoder, a magnetic rotary encoder, or a brushless resolver.

In a further embodiment, the drive motor 230 may include an integral gear head 234 to provide a desired output torque at the output shaft 232. It will be appreciated by those of ordinary skill in the art that a desired torque at the output shaft 232 of drive motor 230 may be effected using a gear train (not shown in figures) associated with the drive coupling mechanism 240.

Figure 6:
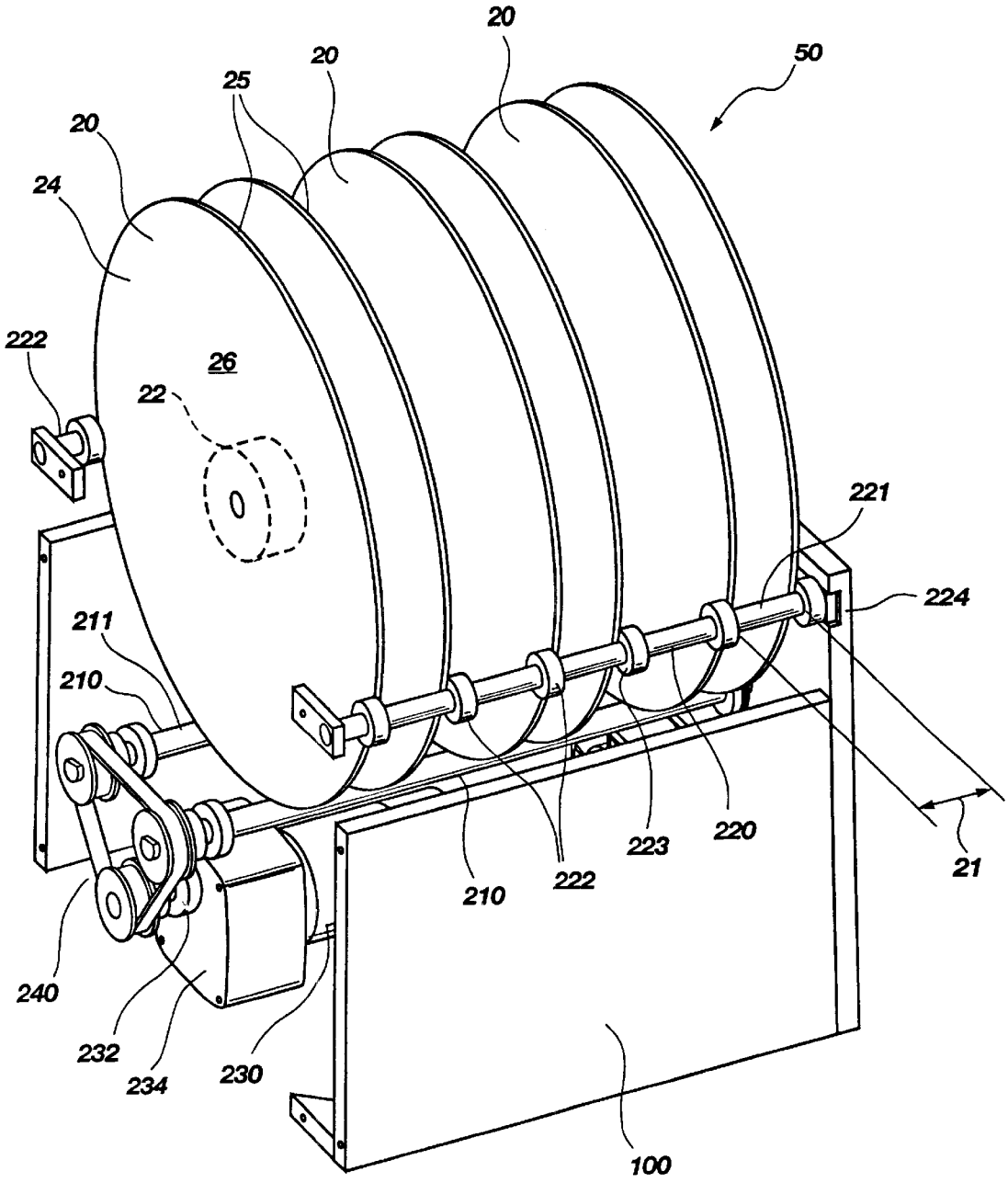
FIG. 6 is a perspective view of the carrier tape recycling apparatus of the present invention with a portion of the housing removed for clarity.

The drive coupling mechanism 240 is configured to transmit rotation of the output shaft 232 of the drive motor 230 to the drive shaft or shafts 210 such that each drive shaft 210 (if more than one) rotates at substantially the same rotational speed. In one embodiment of the invention, as shown in FIGS. 5 through 7, the drive coupling mechanism 240 comprises a belt and pulley system. The belt and pulley system includes (see FIG. 7) a drive pulley 242 secured to the output shaft 232 of drive motor 230 and shaft pulleys 244 secured to the respective ends of drive shafts 210. A belt 246 couples the drive pulley 242 to each shaft pulley 244, which are of substantially equal diameter. Rotation of the output shaft 232 of drive motor 230 and attached drive pulley 242 is transmitted to the shaft pulleys 244 by belt 246, and, because the shaft pulleys 244 are of equal diameter, the drive shafts 210 (if more than one) rotate at substantially the same speed. The belt 246 may be—and the drive pulley 242 and shaft pulleys 244 adapted for use with—any suitable belt configuration known in the art, such as, for example, a round belt, a flat belt, a V-belt, or a timing belt. Commercially available standard types and sizes of belts and pulleys are believed suitable for this purpose.

Those of ordinary skill in the art will understand that the drive coupling mechanism 240 may be any other suitable mechanism known in the art adapted to rotate the drive shaft or shafts 210 and, if more than one drive shaft 210, to rotate the drive shafts 210 at substantially the same rotational speed. By way of example, the drive coupling mechanism 240 may comprise a chain and sprocket drive or, alternatively, a gear drive.

A unique feature of the recycling apparatus 50 is that the reel drive mechanism 200 provides a slip drive. The outer circumferential edges 25 of a tape reel 20 disposed in the recycling apparatus 50 rest against the outer circumferential surface, or cylindrical drive surface, 211 of each drive shaft 210. As the drive shafts 210 are rotated by the drive coupling mechanism 240 and drive motor 230, rotation of the drive shafts 210 is transmitted to the tape reel 20 via frictional forces existing between the cylindrical drive surface 211 of a drive shaft 210 and the outer circumferential edges, or cylindrical surfaces, 25 of the tape reel 20. Because only frictional forces couple the drive shafts 210 to the tape reel 20, the tape reel 20 is allowed to slip, or cease rotating, relative to the drive shafts 210. The slip drive, therefore, allows all of the tape reels 20 disposed in the reel drive mechanism 200 of a recycling apparatus 50 to rotate, or to stall, independent of one another.

Providing independent rotation for all of the tape reels 20 disposed in a recycling apparatus 50 is a positive aspect of the present invention. As previously indicated, a manufacturing system may have multiple feed lines 90 dispensing bare carrier tape 10 therefrom. Each feed line 90 may be supplying a different part, and varying numbers of parts, to the manufacturing system. Each feed line 90 may dispense bare carrier tape 10 at a different rate and, further, one feed line 90 may be halted while other feed lines 90 continue to dispense bare carrier tape 10. In sum, all of the tape reels 20 disposed in a recycling apparatus 50 may not rotate at precisely the same speed, receive bare carrier tape 10 at the same rate, or rotate simultaneously. The slip drive provided by reel drive mechanism 200, however, enables each individual tape reel 20 disposed in a recycling apparatus 50 to rotate and receive carrier tape 10 independent of all other tape reels 20 disposed in the recycling apparatus 50, thereby compensating for variation in carrier tape feed rates of multiple feed lines 90 dispensing bare carrier tape 10 from a manufacturing system. The slip drive provided by reel drive mechanism 200 also enables a single carrier tape recycling apparatus 50 according to the present invention to be used with, and to receive bare carrier tape 10 from, more than one manufacturing system.

The slip drive provided by the reel drive mechanism 200 also prevents excessive tension from being imparted to the bare carrier tape 10 being wound onto a tape reel 20, as the outer circumferential edges 25 of a tape reel 20 may slide relative to the outer circumferential surface 211 of a drive shaft 210. Excessive tension on the bare carrier tape 10 dispensing from a feed line 90 of a manufacturing system may disrupt operation of a feed mechanism indexing bare carrier tape 10 through that feed line 90.

The carrier tape recycling apparatus 50 may also include a fan 250 positioned proximate a vent hole 150 in the housing 100. Operation of the fan 250 circulates air around the reel drive mechanism 200, thereby cooling the drive motor 230 and facilitating removal of any heat generated by the slip drive provided by reel drive mechanism 200. The fan 250 may be any suitable fan known in the art capable of circulating a sufficient volume of air to achieve the desired cooling.

In another embodiment, the recycling apparatus 50 includes one or more sensors 260 (see FIG. 8) configured to measure a quantity of carrier tape 10 disposed on a tape reel 20 and/or to indicate when a tape reel 20 is full of carrier tape 10. The sensor or sensors 260 may be electrically connected to a closed-loop control system for controlling the drive motor 230, as described above, such that rotation of the drive motor output shaft 232 and, therefore, the drive shafts 210 may be stopped when a sensor 260 indicates that a tape reel 20 is full of carrier tape 10. Any suitable sensor known in the art may be used to measure the quantity of carrier tape 10 wound on a tape reel 20. Optical sensors as well as contact type proximity sensors are believed suitable for this purpose.

The present invention also encompasses a method of using the carrier tape recycling apparatus 50 to recycle bare carrier tape 10 dispensed from a manufacturing system. In an exemplary embodiment of a method of recycling carrier tape 10 according to the present invention, the recycling apparatus 50 is located proximate a manufacturing system having one or more feed lines 90 dispensing bare carrier tape 10 therefrom. The recycling apparatus 50 is fitted to support at least a number of tape reels 20 corresponding to the number of feed lines 90 dispensing bare carrier tape 10 from the manufacturing system. For example, as shown in FIG. 5, if three feed lines 90 are each dispensing bare carrier tape 10 from the manufacturing system, the recycling apparatus 50 must be configured to hold at least three tape reels 20, although the recycling apparatus 50 may be configured to support multiple tape reels 20 for each feed line 90. The recycling apparatus 50 must also be fitted for the specific size of tape reels 20 to be disposed therein.

To configure the reel drive mechanism 200 of a recycling apparatus 50 for use with a specific number and size of tape reels 20, a suitable number of guides 222 are disposed on the guide shaft or shafts 220. The guides 222 are axially positioned on, and secured to, a guide shaft 220 such that an outer surface 223 of a guide 222 lies adjacent the outer surface 26 of each disk-shaped side plate 24 of a tape reel 20. For an embodiment in which three tape reels are supported in the reel drive mechanism 200 and the reel drive mechanism 200 includes two guide shafts 220, as shown in FIGS. 5 through 10, each of the two guide shafts 220 includes two guides 222 to laterally support each tape reel 20. Therefore, each of the three tape reels 20 is bracketed by outer surfaces 223 of four guides 222. To adapt the recycling apparatus 50 to a specific diameter tape reel 20, the guide shaft or shafts 220 are positioned relative to the drive shaft or shafts 210 such that the outer cylindrical surface 221 of each guide shaft 220 is proximate, but not necessarily contacting, the outer circumferential edges 25 of a tape reel 20. The adjustable couplings 224, as described above, are used to locate and secure a guide shaft 220 in the desired position.

At least one tape reel 20 corresponding to each feed line 90 is disposed in the reel drive mechanism 200 of the recycling apparatus 50, which has been configured for receiving a specific size and number of tape reels 20 as described above. The bare carrier tape 10 of each feed line 90 is then secured to a hub 22 of a tape reel 20 such that, as the tape reel 20 rotates, the bare carrier tape 10 will wind onto the tape reel 20. A piece of adhesive tape (not shown in figures) may be used to secure the end of a carrier tape 10 to the hub 22 of a tape reel 20. To facilitate attachment of the end of a carrier tape 10 to the hub 22 of a tape reel 20, the hub 22 may have an axial slot 31 (see FIGS. 3 and 4) configured to receive and secure therein the end of a carrier tape 10. Alternatively, the hub 22 of a tape reel 20 may include a spring-biased clip 32 (see FIGS. 3 and 4) secured thereto, or formed thereon, configured to attach the end of a carrier tape 10 to the hub 22.

The drive motor 230 may then be actuated to rotate the drive shaft or shafts 210 via drive coupling mechanism 240 and to rotate the tape reels 20 disposed in the reel drive mechanism 200. As the manufacturing system dispenses bare carrier tape 10, the bare carrier tape 10 is wound onto the hub 22 of a tape reel 20 by rotation of the tape reel 20. If the manufacturing system halts the flow of carrier tape 10 from a feed line 90, the slip drive provided by the reel drive mechanism 200 allows a tape reel 20 receiving bare carrier tape 10 from that feed line 90 to stall. However, the reel drive mechanism 200 will continue to rotationally drive other tape reels 20 disposed therein and receiving bare carrier tape 10 from the manufacturing system. Thus, the reel drive mechanism 200 providing a slip drive enables all of the tape reels 20 disposed in the recycling apparatus 50 to rotate independent of each other while, simultaneously, being driven by a single drive motor 230.

When a tape reel 20 is full of bare carrier tape 10, the full tape reel 20 is removed from the recycling apparatus 50 and an empty tape reel 20 inserted in its place, and the end of a carrier tape 10 is secured to the hub 22 of the empty tape reel 20. The quantity of carrier tape 10 wound on a tape reel 20 may be sensed using sensors 260, as described above, to indicate when a tape reel 20 is full. Because the reel drive mechanism 200 rotationally drives a tape reel 20 at its outer circumferential edges 25 and no shaft is inserted into the shaft hole 28 extending through the hub 22 of a tape reel 20, a full tape reel 20 may simply be lifted out of the reel drive mechanism 200 and recycling apparatus 50. Similarly, an empty tape reel 20 is inserted into the recycling apparatus 50 by simply placing the empty tape reel 20 between the corresponding guides 222 disposed on the guide shaft or shafts 220 such that the outer circumferential edges 25 of the empty tape reel 20 rest upon the cylindrical drive surfaces 211 of the drive shaft or shafts 210.

Removal of a full tape reel 20 and insertion of a replacement tape reel 20 may require severing of the carrier tape 10 feeding the full tape reel 20. If the supply reels feeding carrier tape 10, and the parts borne thereon, to the manufacturing system are the same size as the tape reels 20 disposed in the carrier tape recycling apparatus 50, severing of the bare carrier tape 10 is not necessary as there is a one-to-one ratio between the length of carrier tape 10 wound on a supply reel and the length of carrier tape 10 to be wound on a tape reel 20 disposed in the recycling apparatus 50. Those of ordinary skill in the art will appreciate that the supply reels providing carrier tape 10 to the manufacturing system may be identical to the tape reels 20 usable with the recycling apparatus 50 of the present invention.

To reuse a length of bare carrier tape 10 wound on a tape reel 20 using the carrier tape recycling apparatus 50 of the present invention, it may be necessary to splice together the lengths of bare carrier tape 10 from several tape reels 20 and to wind all of the carrier tape 10 from those tape reels 20 onto a single, larger tape reel for use with other manufacturing equipment, such as, for example, an apparatus for loading parts into the pockets 14 of the carrier tape 10. For example, the carrier tape 10 from three tape reels 20 may be spliced together and wound onto a single tape reel, or master reel, for subsequent reuse.

An exemplary embodiment of a carrier tape recycling apparatus 50 according to the present invention having been described in detail, those of ordinary skill in the art will appreciate the advantageous features of the carrier tape recycling apparatus 50. The recycling apparatus 50 may be easily fitted for use with any suitable size of tape reel 20. Similarly, the recycling apparatus 50 may be adapted for use with any desired number of tape reels 20 in order to accommodate manufacturing systems having multiple feed lines 90 dispensing bare carrier tape 10 to the recycling apparatus 50. The carrier tape recycling apparatus 50 includes a reel drive mechanism 200 providing a slip drive, the slip drive allowing each tape reel 20 disposed in the reel drive mechanism 200 to rotate and receive carrier tape 10 independent of all other tape reels 20 disposed in the reel drive mechanism 200. Further, the slip drive prevents excessive tension from being imparted to the carrier tape 10. Also, the recycling apparatus 50 of the present invention provides for easy removal of tape reels 20 therefrom and for easy insertion of tape reels 20 therein.

Use of a carrier tape recycling apparatus 50 according to the present invention with a manufacturing system adapted to receive parts borne on carrier tape 10 enables bare carrier tape 10 dispensing from the manufacturing system to be recovered for subsequent recycling. The bare carrier tape 10 is conveniently wound onto one or more tape reels 20 for ease of reuse. It is believed that conventional carrier tape 10 may be reused three to five times, or more, prior to any noticeable degradation in integrity of the carrier tape indexing holes 18. Thus, the carrier tape recycling apparatus 50 of the present invention provides a means for extending the useful life of carrier tape 10, thereby reducing manufacturing costs and industrial waste.

The foregoing detailed description and accompanying drawings are only illustrative and not restrictive. They have been provided primarily for a clear and comprehensive understanding of the present invention and no unnecessary limitations are to be understood therefrom. Numerous additions, deletions, and modifications to the exemplary embodiment, as well as alternative arrangements, may be devised by those skilled in the art without departing from the spirt of the present invention and the scope of the appended claims.

What is claimed is:

1. A carrier tape recycling apparatus for winding carrier tape onto at least one tape reel, said at least one tape reel having an axial thickness and including a hub extending between opposing disk-shaped side plates having outer circumferential edges, said carrier tape recycling apparatus comprising:

a reel drive mechanism configured to rotationally drive said at least one tape reel;

a housing configured to support said reel drive mechanism;

at least two drive shafts, each of said at least two drive shafts having opposing ends supported by said housing on a first plane and an outer circumferential surface located for contact with said outer circumferential edges of said at least one tape reel;

at least two guide shafts, each of said at least two guide shafts having opposing ends supported by said housing on a second plane above said first plane and an outer circumferential surface located to be in proximity to said outer circumferential edges of said at least one tape reel; and an adjustable coupling disposed at each of said opposing ends of said at least two guide shafts configured to secure said each of said opposing ends of said at least two guide shafts to said housing.

2. The apparatus of claim 1, wherein said reel drive mechanism comprises:

a drive motor having an output shaft; and a drive coupling mechanism operably coupling said output shaft of said drive motor to at least one of said at least two drive shafts.

3. The apparatus of claim 2, wherein said drive coupling mechanism comprises:

a drive pulley disposed on said output shaft of said drive motor;

a shaft pulley disposed on at least one of said at least two drive shafts; and a belt coupling said drive pulley to said shaft pulley.

4. The apparatus of claim 2, wherein said outer circumferential surface of each of said at least two guide shafts is located for contact with said outer circumferential edges of said at least one tape reel.

5. The apparatus of claim 1, wherein said adjustable coupling disposed at each of said opposing ends of said at least two guide shafts comprises:

a slide block secured to one of said opposing ends of said at least two guide shafts;

a slot disposed in said housing configured to slidably receive said slide block; and a fastener for securing said slide block in said slot.

6. The apparatus of claim 2, further comprising:

at least a first guide disposed on at least one of said at least two guide shafts configured to laterally support said at least one tape reel; and at least a second guide disposed on said at least one of said at least two guide shafts configured to laterally support said at least one tape reel, said at least a second guide having a surface spaced a distance from a surface of said at least a first guide, said distance substantially equal to said axial thickness of said at least one tape reel.

7. The apparatus of claim 2, further comprising a speed control device associated with said drive motor.

8. The apparatus of claim 7, wherein said speed control device is selected from a group consisting of a voltage control device and a current control device.

9. The apparatus of claim 7, wherein said speed control device comprises a closed-loop control system having at least one rotary sensor, said at least one rotary sensor configured to sense rotation of at least one of said output shaft of said drive motor and said at least two drive shafts.

10. The apparatus of claim 1, wherein said reel drive mechanism is configured to rotationally drive said at least one tape reel at a rotational speed of between about 1 and 15 rpm.

11. The apparatus of claim 1, further comprising at least one sensor configured to measure a quantity of carrier tape wound on said at least one tape reel.

12. An apparatus for recycling carrier tape, comprising:

at least one tape reel configured for receiving a length of said carrier tape, said at least one tape reel having an axial thickness and including a hub extending between opposing disk-shaped side plates, each of said opposing side plates having an outer circumferential edge;

a reel drive mechanism configured to receive said at least one tape reel and to rotationally drive said at least one tape reel at said outer circumferential edge of said each of said opposing side plates of said at least one tape reel;

a frame configured to support said reel drive mechanism;

at least two drive shafts, each of said at least two drive shafts having opposing ends supported by said frame on a first plane and an outer circumferential surface in contact with said outer circumferential edge of said each of said opposing side plates of said at least one tape reel;

at least two guide shafts, each of said at least two guide shafts having opposing ends supported by said frame on a second plane above said first plane and an outer circumferential surface disposed proximate said outer circumferential edge of said each of said opposing side plates of said at least one tape reel; and an adjustable coupling disposed at each of said opposing ends of said at least two guide shafts configured to secure said each of said opposing ends of said at least two guide shafts to said frame.

13. The apparatus of claim 12, wherein said reel drive mechanism comprises:

a drive motor having an output shaft; and a drive coupling mechanism operably coupling said output shaft of said drive motor to at least one of said at least two drive shafts.

14. The apparatus of claim 12, wherein said adjustable coupling disposed at each of said opposing ends of said at least two guide shafts comprises:

a slide block secured to one of said opposing ends of said at least two guide shafts;

a slot disposed in said frame configured to slidably receive said slide block; and a fastening element for securing said slide block in said slot.

15. The apparatus of claim 13, further comprising:

a first guide secured to at least one of said at least two guide shafts configured to laterally support said at least one tape reel; and a second guide secured to said at least one of said at least two guide shafts configured to laterally support said at least one tape reel, said second guide having a surface spaced a distance from a surface of said first guide, said distance substantially equal to said axial thickness of said at least one tape reel.

16. The apparatus of claim 13, further comprising a speed control device associated with said drive motor.

17. The apparatus of claim 16, wherein said speed control device is manually operable.

18. The apparatus of claim 17, wherein said speed control device comprises a potentiometer.

19. The apparatus of claim 16, wherein said speed control device comprises a closed-loop control system having at least one rotary sensor, said at least one rotary sensor configured to sense rotation of one of said output shaft of said drive motor and said at least two drive shafts.

20. The apparatus of claim 12, wherein said reel drive mechanism is configured to rotationally drive said at least one tape reel at a rotational speed of between about 1 and 15 rpm.

21. The apparatus of claim 12, further comprising at least one sensor configured to measure a quantity of carrier tape on said at least one tape reel.

22. An apparatus for receiving bare carrier tape from a manufacturing system dispensing bare carrier tape from a plurality of feed lines, said apparatus comprising:

a plurality of tape reels, said plurality of tape reels including at least one tape reel for receiving bare carrier tape from each feed line of said plurality of feed lines dispensing bare carrier tape from said manufacturing system;

a reel drive mechanism configured to rotate each tape reel of said plurality of tape reels independent of rotation of all other tape reels of said plurality of tape reels;

a housing configured to support said reel drive mechanism;

at least two drive shafts, each of said at least two drive shafts having opposing ends supported by said housing on a first plane and an outer circumferential surface located for contact with said outer circumferential edges of said at least one tape reel;

at least two guide shafts, each of said at least two guide shafts having opposing ends supported by said housing on a second plane above said first plane and an outer circumferential surface located to be in proximity to an outer circumferential edge of said at least one tape reel; and an adjustable coupling disposed at each of said opposing ends of said at least two guide shafts configured to secure said each of said opposing ends of said at least two guide shafts to said housing.

23. A method of recycling a length of bare carrier tape, comprising:

attaching an end of said length of bare carrier tape to a hub of a tape reel;

supporting an outer cylindrical surface of said tape reel between at least two guide shafts mounted on a first plane;

imparting frictional forces to said outer cylindrical surface of said tape reel with at least two drive shafts mounted on a second plane below said first plane to rotate said tape reel and to wind said length of bare carrier tape around said hub of said tape reel; and sensing a quantity of bare carrier tape wound on said hub of said tape reel.

24. A method of winding carrier tape onto a tape reel, comprising:

securing an end of said carrier tape to a hub of said tape reel;

adjusting at least two guide shafts extending transversely to said tape reel such that said at least two guide shafts support a circumferential edge of said tape reel; and rotating said tape reel with at least two drive shafts to wind said carrier tape around said hub of said tape reel.

25. The method of claim 24, further comprising halting a supply of said carrier tape to said tape reel to stall said tape reel.

26. A method of recycling carrier tape dispensed from a plurality of feed lines of a manufacturing system, comprising:

securing an end of said carrier tape dispensing from one feed line of said plurality of feed lines to a hub of a first tape reel;

securing an end of said carrier tape dispensing from at least one other feed line of said plurality of feed lines to a hub of another tape reel;

supporting an outer cylindrical surface of said first tape reel and an outer cylindrical surface of said another tape reel between at least two guide shafts;

imparting frictional forces to an outer cylindrical surface of said first tape reel with at least two drive shafts to rotate said first tape reel and to wind said carrier tape dispensing from said one feed line around said hub of said first tape reel;

imparting frictional forces to an outer cylindrical surface of said another tape reel with said at least two drive shafts to rotate said another tape reel to wind said carrier tape dispensing from said at least one other feed line around said hub of said another tape reel; and sensing a quantity of carrier tape wound on at least one of said first tape reel and said another tape reel.

27. The method of claim 26, further comprising stalling rotation of one of said first tape reel and said another tape reel by halting said dispensing of said carrier tape from one of said one feed line and said at least one other feed line.

28. The method of claim 26, further comprising:

stalling rotation of said first tape reel by halting said dispensing of said carrier tape from said one feed line; and rotating said another tape reel.

29. A method of recycling carrier tape flowing from a plurality of feed lines of a manufacturing system, comprising:

providing an apparatus having a reel drive mechanism configured to receive and rotationally drive a plurality of tape reels;

disposing a plurality of tape reels in said reel drive mechanism;

supporting an outer circular surface of each tape reel of said plurality of tape reels between at least two guide shafts on a first plane;

contacting said outer circular surface of each tape reel of said plurality of tape reels against at least two drive surfaces of said reel drive mechanism, said at least two drive surfaces located on a second plane below said first plane;

securing an end of carrier tape flowing from each feed line of said plurality of feed lines to one tape reel of said plurality of tape reels;

rotating said at least two drive surfaces of said reel drive mechanism to impart frictional forces to said outer circular surface of said each tape reel and to rotate said each tape reel; and winding said carrier tape flowing from said each feed line onto a corresponding said one tape reel.

30. The method of claim 29, further comprising stalling rotation of at least one tape reel of said plurality of tape reels by stopping flow of said carrier tape from a feed line of said plurality of feed lines supplying said carrier tape to said at least one tape reel.

31. The method of claim 29, further comprising laterally supporting said each tape reel disposed in said reel drive mechanism.

32. The method of claim 29, wherein said each tape reel has a diameter and an axial thickness, said method further comprising configuring said reel drive mechanism to receive tape reels having said diameter and said axial thickness.

33. The method of claim 29, further comprising:

winding said carrier tape onto said one tape reel of said plurality of tape reels until said one tape reel is full;

lifting said one tape reel out of said reel drive mechanism; and inserting an empty tape reel to replace said one tape reel.

34. The method of claim 29, further comprising:

winding said carrier tape flowing from one feed line of said plurality of feed lines onto said one tape reel of said plurality of tape reels until said one tape reel is full;

severing said carrier tape flowing from said one feed line;

securing a severed end of said carrier tape flowing from said one feed line to another tape reel of said plurality of tape reels disposed in said reel drive mechanism.

35. The method of claim 29, further comprising sensing a quantity of said carrier tape wound on at least one tape reel of said plurality of tape reels.

36. The method of claim 29, further comprising:

winding a first length of said carrier tape onto said one tape reel of said plurality of tape reels disposed in said reel drive mechanism;

winding at least one other length of said carrier tape onto another tape reel of said plurality of tape reels disposed in said reel drive mechanism;

removing said one tape reel and said another tape reel from said reel drive mechanism; and splicing an end of said first length of said carrier tape to an end of said at least one other length of said carrier tape to join said first length of said carrier tape and said at least one other length of said carrier tape and form a single continuous length of carrier tape.

37. The method of claim 36, further comprising winding said single continuous length of carrier tape onto said one tape reel of said plurality of tape reels.

38. The method of claim 29, further comprising manually altering a rotational speed of said at least two drive surfaces of said reel drive mechanism.

39. The method of claim 29, further comprising maintaining a desired rotational speed of said at least two drive surfaces of said reel drive mechanism with a closed-loop control system.

40. The method of claim 39, further comprising sensing a rotational speed of said at least two drive surfaces of said reel drive mechanism with a rotary sensor.

* * * * *